United States Patent [19]

Clauss

[11] Patent Number: 4,607,676

[45] Date of Patent: Aug. 26, 1986

[54] ROLL-UP AWNING CONSTRUCTION

[75] Inventor: Ulrich Clauss, Bissingen, Fed. Rep. of Germany

[73] Assignee: Claus Markisen, Bissingen-Ochsenwang, Fed. Rep. of Germany

[21] Appl. No.: 653,323

[22] Filed: Sep. 24, 1984

[30] Foreign Application Priority Data

Dec. 8, 1983 [DE] Fed. Rep. of Germany ..... 3344359

[51] Int. Cl.[4] ..... E04F 10/06

[52] U.S. Cl. ..... 160/74; 160/82

[58] Field of Search ..... 160/75, 66, 72, 74, 160/82, 83 M

[56] References Cited

U.S. PATENT DOCUMENTS

| | | | |
|---|---|---|---|
| 600,306 | 3/1898 | Decker | 160/83 M |
| 1,723,707 | 8/1929 | Ralston et al. | 160/72 X |
| 1,830,737 | 11/1931 | Hendrix | 160/74 |
| 1,959,700 | 5/1934 | Anion et al. | 160/72 X |
| 2,050,835 | 8/1936 | Fogh | 160/82 X |
| 4,320,792 | 3/1982 | Licciardi et al. | 160/74 |

FOREIGN PATENT DOCUMENTS

| | | | |
|---|---|---|---|
| 54025 | 12/1937 | Denmark | 160/74 |
| 2449067 | 4/1976 | Fed. Rep. of Germany | 160/75 |
| 2492449 | 4/1982 | France | 160/66 |
| 2038912 | 7/1980 | United Kingdom | 160/72 |

*Primary Examiner*—Ramon S. Britts
*Assistant Examiner*—David M. Purol
*Attorney, Agent, or Firm*—Frishauf, Holtz, Goodman & Woodward

[57] ABSTRACT

An awning construction includes two guide rails, disposed below a wind-up roller and extending vertically and spaced apart from and parallel to one another. The guide rails are secured to the wall of a building. Two arms, connected at one end with a cross rail extending parallel to the wind-up roller, travel inside the guide rails. In order to impar a pivoting movement of the arms, two racks are seated in the guide rails and can be made to engage two gear segments, so that when the awning web is unwound from the rolling-in position the two arms, extending substantially vertically, initially slide downward in the guide rails until the racks engage the gear segments, and then the arms pivot about the racks.

17 Claims, 8 Drawing Figures

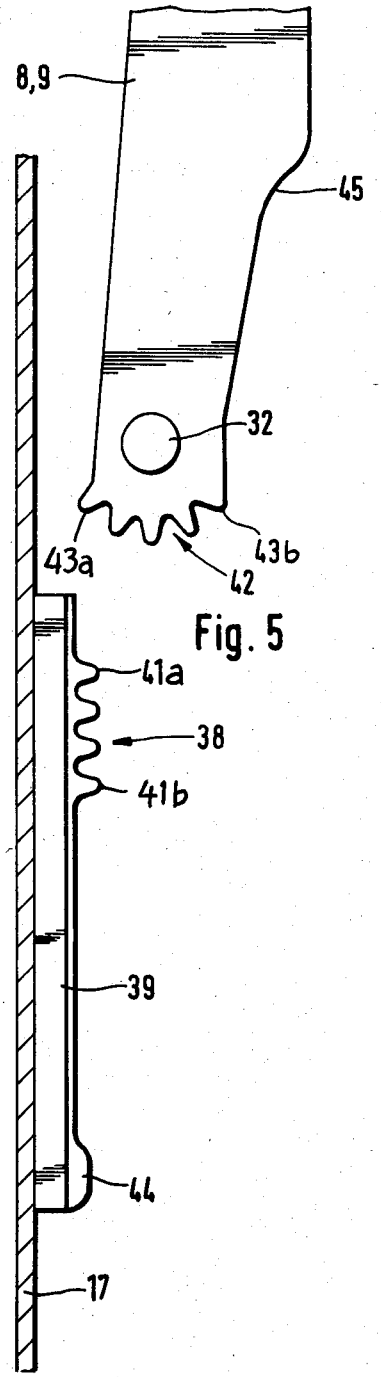
Fig. 5
Fig. 6
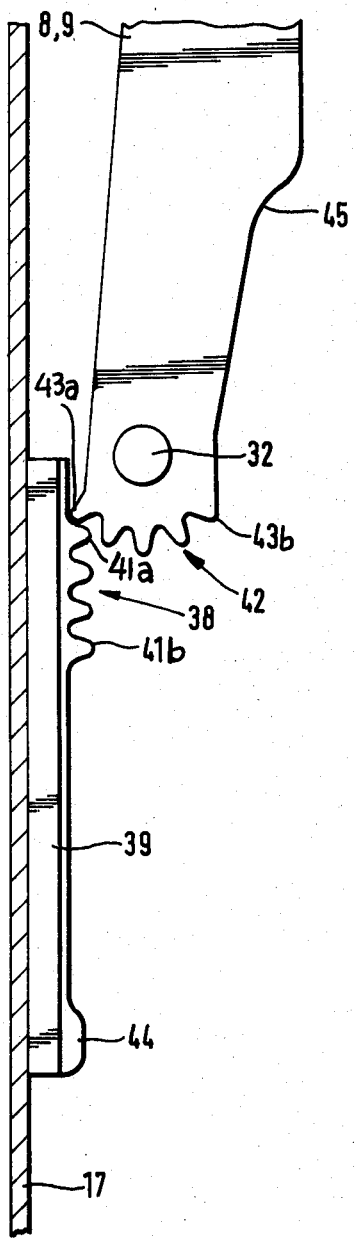

ROLL-UP AWNING CONSTRUCTION

The present invention relates to an awning construction, and more particularly to a roll-up awning, in which an awning web, typically a fabric web, is supported on arms which can extend laterally from a building, e.g., adjacent a window; and in which the awning is so constructed that the angle of extent of the arms from the window is variable and the arms are rotatable about 180°, so that the awning is either completely rolled up and the arms are flat against the building; or the arms are extended from the building, at a selected angle, to shade a window; or the arms can be folded flat down against the building, with the awning web covering the window, for example to obtain room-darkening effects.

BACKGROUND

Difficulties arise in the construction of awnings of this type when the support arms are rotated about an angle of more than 90°, since, then, forces applied against the arms of the awning, upon roll-up of the awning web, prevent lifting of the arms of the web of the awning, thus interfering with proper placement of the arms in vertical position. Awnings of this type also are deemed to be subject to wind damage, since winds may balloon out an awning which has been extended, and may cause violent flipping upwardly of the awning web. This may cause damage to the awning and/or the adjacent building or window constructions, and, additionally, interferes with the use to which the awning is intended to be put.

THE INVENTION

It is an object to improve an awning construction to permit the awning holding arms to move out of their vertical position of rest, in which the cross rail, or rod, holding the projecting end of the awning is at the top, through the 90° position and into the other vertical position, in which the cross rail is located below the fulcrum of the holding arms, yet without the danger that when the awning is rolled in it will be impossible to fold the arms back into their position of rest, again passing through the 90° position.

Briefly, the awning includes a web, typically a fabric web, attached to a cross rail which is secured, at its two ends, to an arm, each. The arms have their other ends located slidably longitudinally in guide rails secured to a building or to a window frame, the arms, additionally, being pivotably connected to the guide rails. The guide rails have, each, first engagement elements, located in horizontal alignment with respect thereto, the first engagement elements comprising at least one projecting element positioned in the path of movement of second engagement elements which are located on the arms adjacent the pivoting end. The second engagement elements on the arm, each, comprise at least two spaced projections, the spacing of the second projecting element permitting the first projecting element, on or in the guide rails, to fit between the two projecting elements attached to the arms.

In accordance with a preferred feature of the invention, the first projecting element attached to or secured in the guide rails is a rack, the at least one projecting element thereof being formed by the rack teeth; and the second projecting elements, secured to the arms, comprise a segmental gear, the gear teeth of the segmental gear being arranged to engage the gear teeth of the rack.

DRAWINGS

FIGS. 5–8 illustrate the cooperation between the rack and segmental gear segments of one arm and the cooperation between the cam land and the associated cam track, in various operating positions and in side view.

DETAILED DESCRIPTION

Figure 1:
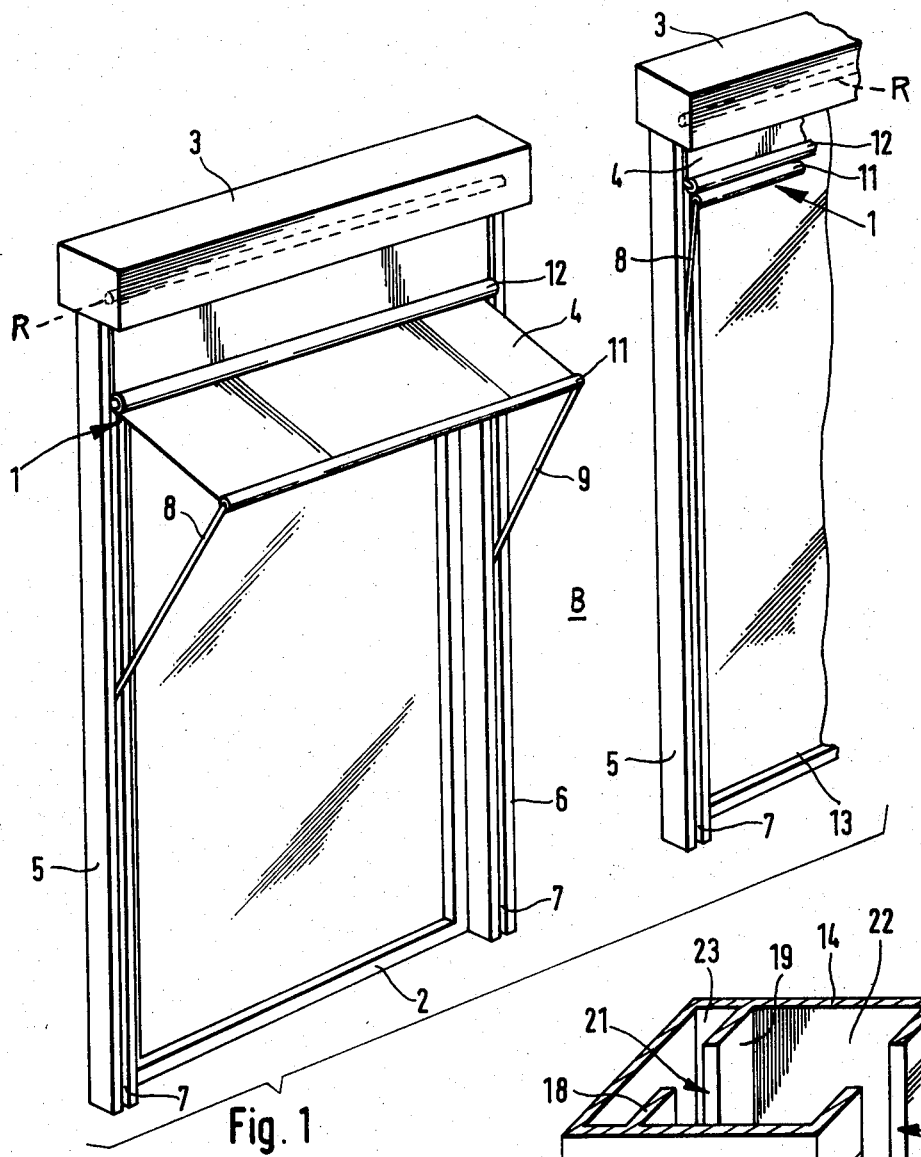
FIG. 1 is a perspective view of two awning constructions according to the invention, which are disposed in front of two windows of a building, not otherwise shown, and which are in two different operating positions.

FIG. 1 shows an awning 1 which is disposed in front of a window 2 of a building B and contains in a box 3 open at the bottom a wind-up roller R which is not otherwise visible and is shown only schematically. On this wind-up roller R, an awning web 4 which is secured at its rear edge to the wind-up roller R can be wound up. Below the wind-up roller, two guide rails 5 and 6, which extend parallel to one another vertically and spaced apart from one another, are secured to the wall of the building beside the window 2. The two guide rails 5 and 6 are elongated profile sections identical to one another and provided with a longitudinal slit 7, and they serve to provide slidable support for two holding arms 8 and 9, which lead at one end through the slits 7 into the interior of the guide rails 5 and 6 and at the other end are secured on a cross rail 11, which may be weighted, and which extends parallel to the wind-up roller.

In common with the arms 8 and 9, a deflection roller 12 moves in front of the guide rails 5 and 6, extending parallel to the cross rail 11 and being joined to the ends toward the guide rail of the two arms 8 and 9 in a manner to be explained below.

The same awning 1 is shown disposed in front of a further window 13 beside the window 2; this awning, however, is in a different operating position, namely the position of rest, in which the awning web 4 is rolled in. In this position, the arms 8 and 9 are folded upward, extending approximately vertically, so that the cross rail 11 is located directly below the rotatable deflection roller 12.

Figure 2:
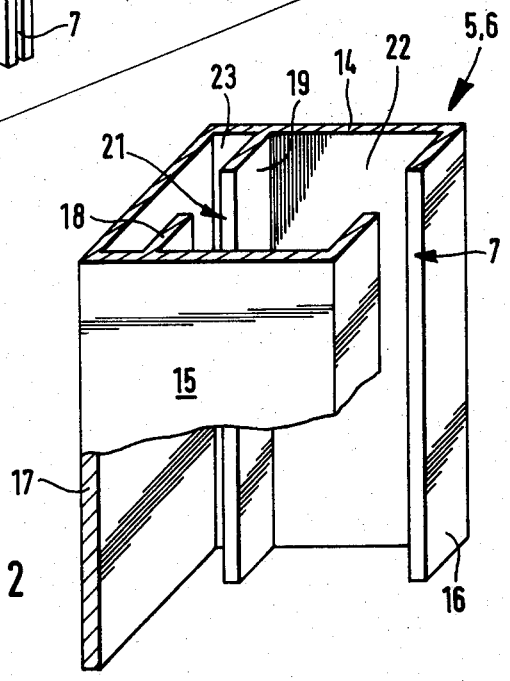
FIG. 2 is a portion of a guide rail of the awning of FIG. 1, with a partially broken away side wall, seen in perspective.
Figure 3:
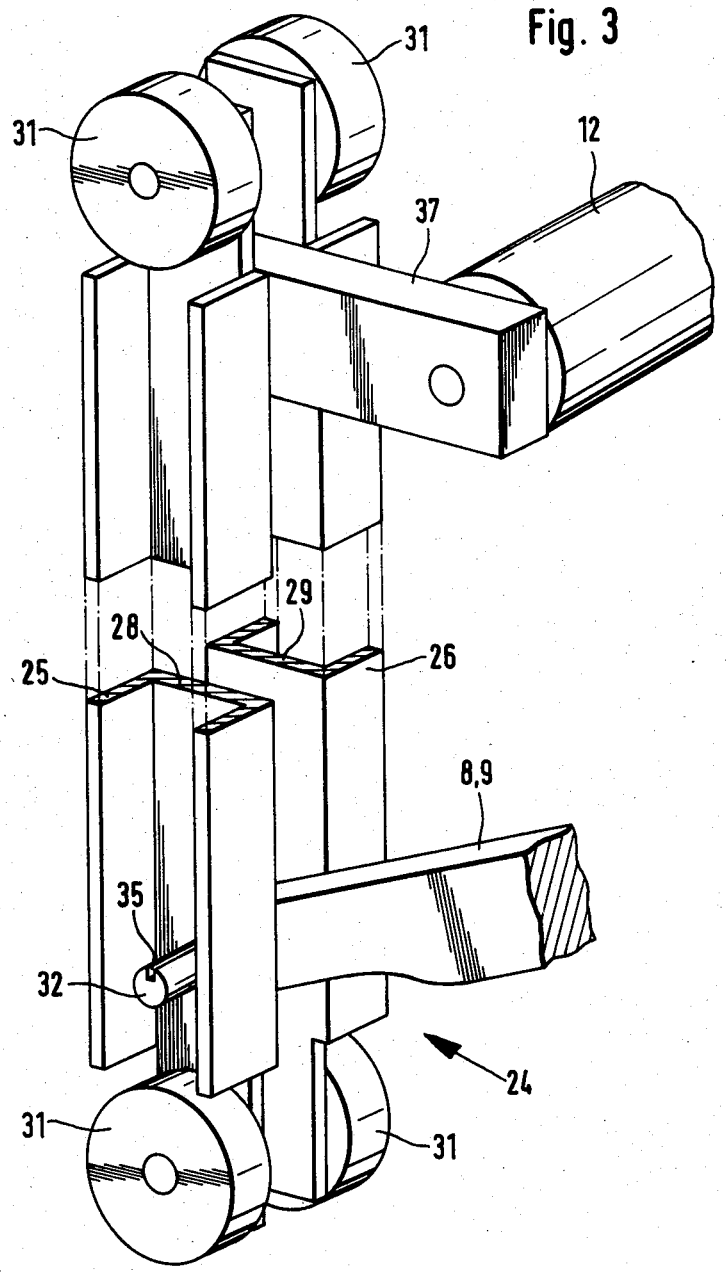
FIG. 3 is a foreshortened perspective view of one of the two guide sliders of the awning of FIG. 1, with the holding arm shown broken away.

The guide rails 5 and 6 have the approximately rectangular cross section shown in FIG. 2, defined by two side wall 14 and 15 as well as the front wall 16, which contains the slit 7, and the rear wall 17, which extends parallel to and spaced apart from the front wall 16. Adjacent to the rear wall 17, two strips 18 and 19 extending over the entire length of the guide rails 5 and 6, respectively, are formed onto the inside of the two side walls 14 and 15, being oriented toward one another and delimiting a continuous longitudinal slit 21. In this manner, the interior of the guide rails 5 and 6 is divided by the two strips 18 and 19 and by the continuous longitudinal slit 21 into a front chamber 22 and a rear chamber 23. The front chamber 22 serves to receive a guide slider 24, shown in FIG. 3, in which the arms 8 and 9, which are shown broken away in FIG. 3, are rotatably retained.

The guide slider 24 is embodied by two parallel channel structures 25, 26 of a U-shaped profile, which extend spaced apart from one another. In a known manner, these channel structures are secured to one another at their bases 28 and 29, so that the free legs of the U-channels 25 and 26 point away from one another. To facilitate the movement of the guide slider 24 in the front chamber 22 of the guide rails 5 and 6, the guide slider 24 has two coaxial rollers 31 each at its upper and lower ends which are rotatably retained at the base 28 and 29, respectively, of each of the two channels 25 and 26 and project outward with their circumferential surface beyond the free legs of the U-channels 25 and 26; hence the free legs of the U-channels are shown foreshortened in FIG. 3 in the vicinity of the rollers 31.

In operation, the guide rollers 31 travel on the inside of the front wall 16 on both sides of the longitudinal slit 7, one each on one, and on the strips 18 and 19 dividing the front chamber 22 from the rear chamber 23 on the other.

Just above the lower pair of rollers 31, the respective arm 8 or 9 is pivotably retained in the guide slider 24 by a pivot tang 32 which extends axially parallel to the rollers 31. The pivot tang 32 leads through two openings, which are in alignment with one another, in the bases 28 and 29 of the two U-channels 25 and 26 as well as through the end of the arm 8 or 9 toward the guide rail, this end being located between the two U-channels 25 and 26; to this end, as shown in FIG. 3, these channels are spaced apart from one another by a distance equal to or slightly greater than the width of each arm 8 or 9, so that the arms 8 and 9 can pivot into the space between the U-channels 25 and 26. In order to bias the arms 8 and 9 via the pivot tang 32, the pivot tang is secured, preferably rotationally fixedly, in a known manner to the end toward the guide rail of the associated arm 8, 9 and projects outward beyond the base 28 or 29, so that a spirally wound leaf spring 33, shown in FIG. 4, can be attached to the projecting portion of the tang 32. The inner end 34 of the spring 33 is seated in a longitudinal slit 35 (FIG. 3) in the periphery of the pivot tang 32, and the outer end 36 of the spring 33 is supported on an edge of a leg of the U-channel 25 or 26 or, reaching adjacent a roller 31, on the rail 5, 6.

In the vicinity of the upper pair of rollers 31, a bracket 37 projects approximately at right angles between the two U-channels 25 and 26 forming the frame of the guide slider 24; the bracket 37 is firmly connected to the U-channels 25 and 26 and when the guide slider 24 is inserted projects outward from the guide rails 5 and 6 through the longitudinal slit 7. The bracket 37 serves to retain the rotatable deflection roller 12.

To permit the arms 8 and 9 to assume the operating position shown in connection with the window 13 in FIG. 1, in which the cross rail 11 is located directly below the deflection roller 12, the length of the guide slider 24 is dimensioned in the vertical direction such that the distance between the pivot tang 32 of the arms 8 and 9 and the bracket 37, or the distance between the pivot tang 32 and the underside of the deflection roller 12, is correspondingly greater than the distance between the pivot tang 32 and the front edge of the cross rail 11.

Figure 4:
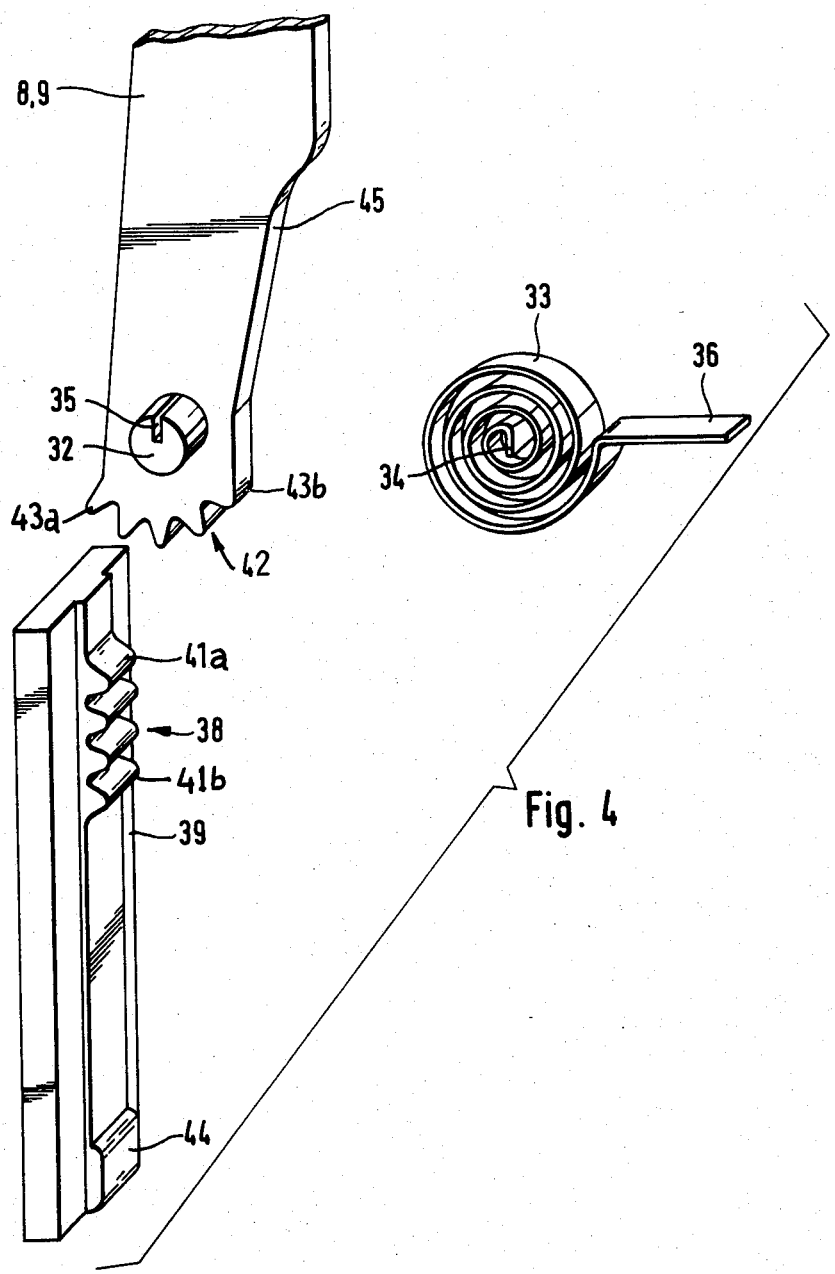
FIG. 4 shows the first and second engagement elements of the awning of FIG. 1 in a perspective view and also shows the volute spring for biasing the associated holding arm.

To effect the pivoting movement of the arms 8 and 9, as shown in FIG. 1, which initially are folded upward and then slide vertically downward, the rack section 38 shown in FIG. 4 is seated in the rear chamber 23 (FIG. 2) of the guide rails 5 and 6. The rack section 38 is formed onto a base plate 39, which in cross section corresponds to the cross section of the rear chamber 23, while the rack section 38 protrudes with its teeth through the centrally extending longitudinal slit 21 and on into the front chamber 22. A gear segment 42 cooperates with the rack section 38 and its teeth are capable of engaging the teeth of the rack section 38; to this end, as shown in FIG. 4, the gear segment 42 is formed onto the end of the arms 8 and 9 nearer the guide rail 5 and 6. The arrangement is such that the axis of the gear segment 42 coincides with the axis of the pivot tang 32, so that when the arm 8, 9 retained in the guide slider 24 is moved, together with the guide slider, past the rack section 38, the teeth of the gear segment 42 engage the teeth of the rack section 38, and a corresponding rotational movement is imparted to the gear segment 42, causing a cycloidal movement of the arms 8 and 9.

Below the rack section 38, and at a predetermined distance from it, a cam land 44 is formed onto the base plate 39, the land likewise projecting through the longitudinal slit 21 but being elevated from the base plate 39 only to such an extent that the arm 8, 9, folded over into the lower vertical position, can move past the cam land 44 with its gear segment 42, or with the last tooth **43*b* thereof which when the arms 8, 9 are folded vertically downward is adjacent to the base plate 39. The cam land 44 cooperates with a cam track 45 which is embodied on the underside of the arms 8, 9 and has the shape shown in FIG. 4, the highest point on the cam track 45 being spaced apart from the adjacent tooth 43*b* by approximately the same distance as that by which the lowermost tooth 41*b* of the rack section 38 is spaced apart from the cam land 44** to produce the function to be described below; from the function, the dimensions and precise position will also be understood.

Operation

As already explained above, in the rolled-in position of the awning 1, the arms 8 and 9 are folded up, extending substantially vertically upward, and in this position the cross rail 11, as shown for the window 13 in FIG. 1, is located immediately below the deflection roller 12. Beginning in this position, the awning web 4 can be unwound from the wind-up roller, e.g., by a spindle engaging the wind-up roller R of the awning in box 3, in accordance with well known constructions. The weight of the apparatus, comprising the arms 8 and 9, the associated guide slider 24 sliding in the guide rails 5 and 6, the cross rail 11 and the deflection roller 12 secured on the guide slider 24, assures that this entire apparatus moves downward in the guide rails 5 and 6, without the arms 8 and 9 folding out and downward from their vertical, upwardly folded position, because the awning web 4 is guided upward underneath and through the deflection roller 12, in fact counter to the biassing force of the volute springs 33.

The end of the arms 8, 9 toward the guide rail moves downward in the guide rails 5 and 6, in the position schematically shown in FIG. 5. In this operating range of the awning 1, the awning web 4 is pulled vertically downward in front of the window 2 or 13 without first being extended outward.

As soon as the first tooth 43*a* of the gear segment 42 of the two arms 8 and 9 meets the first tooth 41*a* of the rack section 38 secured in the guide rails 5 and 6 during the further lowering of the guide slider 24 caused by the unwinding of the awning web 4, as shown in FIG. 6, the guide slider 24 is then no longer capable of moving downward except to the extent that the gear segment 42 rolls off the rack section 38, because the gear segment 42 is located diametrically opposite the point where the cross rail 11 is secured to the arm 8, 9 with respect to the pivot tang 32.

As the drawings show, the point where the rack sections 38 are secured, at the same level, in the guide rails 5 and 6 defines the point at which the arms 8, 9—beginning in the position in which they are vertically folded up—shift into the pivoting movement. The pivot angle attained depends upon how far the awning web 4 is unwound; compare FIGS. 6 and 7.

Figure 8:
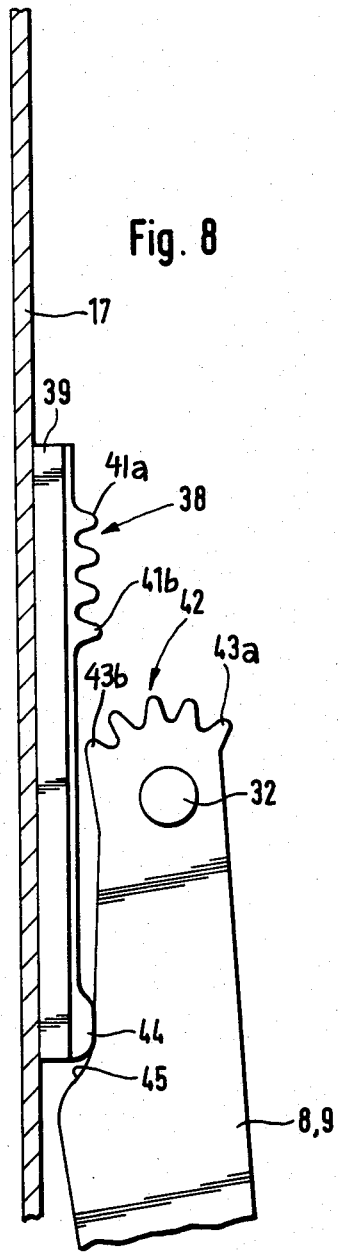

Since in the exemplary embodiment shown, a further lowering of the awning web 4 is supposed to be possible after the arms 8 and 9 have folded over into the position in which they are suspended vertically downward, the rack section 38 is of a length such that—as soon as this position is attained—the gear segment 42 can become disengaged from the rack section 38, as shown in FIG. 8. It is thereby possible for the arms 8 and 9, now in the position suspended vertically downward, to execute a further downwardly directed sliding movement, together with their guide slider 24, in the guide rails 5 and 6; in so doing, the awning web 4 is drawn vertically downward in front of the window 2 as far as the cross rail 11.

Figure 7:
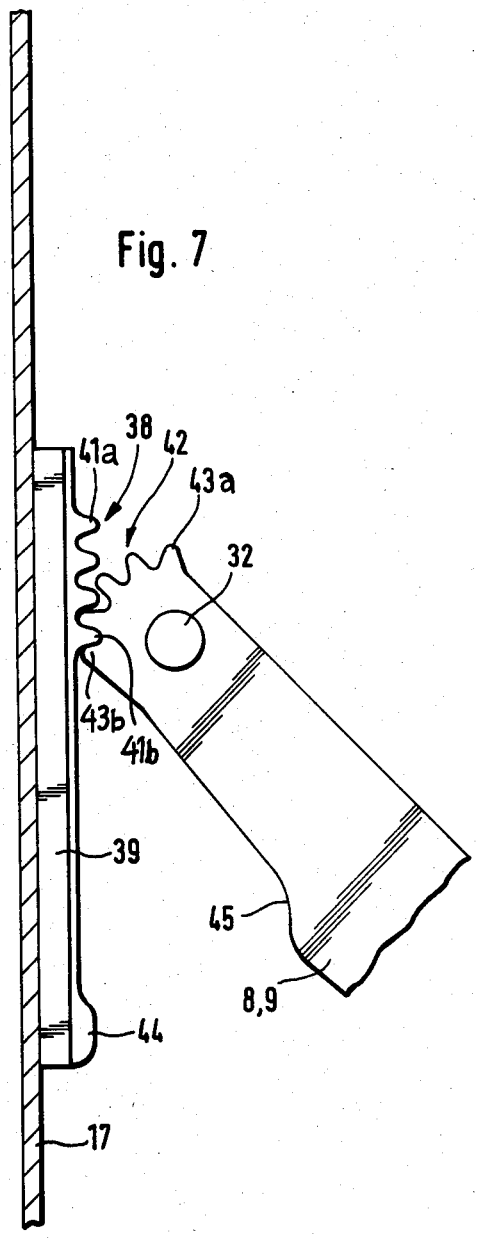

When the awning 1, now in the last position described above, is then rolled in again, the guide sliders 24 move upward, along with the downwardly suspended arms 8 and 9, because of the traction exerted by the awning web 4. Initially the gear segment 42 moves past the cam land 44 so the land 44 can engage the cam track 45 and the associated arms 8, 9 can pivot some distance upward, toward the position of rest, as they slide along the oblique cam track 45 up to its highest point. The cam track 45 is shaped such that when the tooth 43*b* of the gear segment 42 meets the lowermost tooth 41*b* of the rack section 38, the arms 8 and 9 are already pivoted outward by about 15° to 20° with respect to the vertical; as a result, a force triangle which is favorable for the further pivoting upward of the arms 8 and 9 caused by the roll-off movement of the gear segment 42 on the rack section 38 is produced by the angles formed by the arms 8 and 9 and the angle of the awning web 4 between the deflection roller 12 and the cross rail 11. As the awning web continues to be rolled in, the gear segments 42 again roll off on the rack sections 38, as already described above, causing the arms 8 and 9, which are projecting through the longitudinal slit 7 into the interior of the guide rails 5 and 6, to be folded upward, as shown in FIGS. 7 and 6. As the rolling in of the awning coninues, the position shown in FIG. 5 is finally regained, in which the two arms 8 and 9 are folded upward substantially vertically, while the cross rail 11 is located below the deflection roller 12.

Although it is not expressly described, it will be appreciated that when the awning web 4 is rolled out as well, the cam land 44 engages the cam track 45 as in the rolling-in process, thereby assuring a decrease in the tractive tension in the awning web 4 when the arms 8 and 9 approach the position in which they are suspended vertically downward.

Installation

The awning 1 described thus far can be delivered in prefabricated form to a building construction site, so that after the guide rails 5 and 6 are secured to the facade of the building, the base plate 39, which initially is slidable longitudinally in the rear chamber 23, is adjusted into the correct position with the rack section 38 and the cam land 44 and then temporarily secured in that position to the inside of the rear wall 17 in a known manner by means of set screws, not otherwise shown. As soon as the adjustment of the two base plate 39 in the guide rails 5 and 6 has been completed, the base plate 39 is drilled through from the front, through the longitudinal slits 7 and 21, and immovably screwed fast to the rear wall 17, for instance by means of self-tapping screws.

Because of the embodiment of the two cooperating engagement elements 38, 42, a positive locking of the arms 8, 9 is attained in both directions of movement, so that when the awning web 4 is rolled in, the arms 8, 9 must first be folded up into the vertical position corresponding to the position of rest before they can move upward in the guide rails 5, 6 as the rolling in of the awning web 4 continues.

When the awning is rolled out, the arms 8, 9 can pivot about approximately 180°, if the extensions 41 of the first engagement element 38 are embodied by teeth of a rack section 38 extending parallel to the associated guide rail 5 or 6 and the extensions 43 of the second engagement element 42 are embodied by the teeth of a gear segment 42, the center point of which is located coaxially with the pivot axis 32 of the associated arm 8 or 9. In this arrangement, the two rack sections 38 may be secured at a level such that the uppermost tooth is located at a point at which the vertical movement of the arms 8, 9 shifts to the pivoting movement, so that the awning web 4, together with the cross rail 11, initially moves downward vertically in front of the window for a predetermined distance, before the awning 1 begins to be rolled outward.

However, in the case of very high windows it is desirable that the awning 1 be lowerable still further, for instance in order to darken the room inside. Then the arms 8, 9 are translated fully into the downwardly pointing vertical position. The length of the two rack sections 38 is such that the lowermost tooth is at a level at which the gear segments 42 of the arms 8, 9, when the arms are pivoted by about 180° from the original position, become disengaged from the rack sections 38.

In order to reduce the tractive tension on the awning web 4, which is required in order to pivot the arms 8, 9 upward once again when the awning is raised, existing when the awning is lowered completely and the arms 8, 9 have assumed their position pointing vertically downward, a cam land 44 is disposed beneath the first engagement element 38. This land cooperates with a cam track 45 on the underside of the associated arm 8 or 9 in such a manner that when the arm 8 or 9, which is folded essentially vertically downward, slides over the cam track, it is pivoted about a predetermined angle in the direction of the position of rest when it engages the first engagement element 38. This cam land 44, together with its cam track 45, in fact provides a more favorable lever ratio for the upward pivoting of the arm 8 or 9 than does the corresponding gear segment 42, because the distance from the cam land 44 to the pivot point 32 of the associated arm 8 or 9 is greater than the radius of the pitch circle of the gear segment 42.

The installation and adjustment of the awning are facilitated if the cam land 44 and the rack section 38 are disposed on a common base plate 39, because thus only one structural element needs to be adjusted, while the relative position between the rack section 38 and the cam land 44, which is dictated by the arm 8, 9, is kept constant regardless of adjustment.

Installation is still further simplified when the first and second engagement elements 38, 42 and optionally the cam land 44 also are located in the guide rail 5, 6, embodied as a longitudinally slit, hollow profile section; in that case everything can be delivered to the construction site in a pre-assembled form. The structure is particularly simple when the first engagement means 38 and optionally the cam land 44 are seated in a longitudinally slit chamber of the guide rail 5, 6 which is located adjacent to a wall of the building and is open toward the associated arm 8 or 9; this chamber extends over the entire length of the guide rail 5, 6, so that a continuous profile section can be used, in which the engagement elements and the cam land can all be arrested, while a smooth-walled profile section is available for the arm 8, 9, which slides back and forth or pivots in the guide rail 5, 6, thereby helping to prevent jamming of the arm 8, 9 in the guide rail 5, 6.

Particularly sure sliding of the arms 8, 9 in the guide rails 5, 6 is attained when each of the arms 8, 9 is rotatably retained in an associated guide slider 24, which in turn is longitudinally slidable in the corresponding guide rail 5, 6.

For cases where the awning web 4 is also to be guided downward parallel to the window surface for a predetermined distance initially, even when the arms 8, 9 are extended outward, a deflection roller 12 extending parallel to the windup roller R and retained in a rotatable manner is held on the two guide sliders 24. The distance between this deflection roller 12 and the pivot point 32 of the arms 8, 9 in the two guide sliders 24 is greater than the distance between the pivot points 32 and the cross rail 11.

A very sturdy guide slider 24 is provided if it includes two U-channels 25, 26 extending parallel to and spaced apart from one another and forming a frame; at their base, these U-channels face one another and are joined spaced apart from one another by a predetermined distance. On their upper and lower ends, the U-channels have pairs of guide rollers 31, with which they travel along the inside of the guide rails 5, 6, while the associated arm 8, 9 is retained between the U-channels 25, 26.

The awning construction becomes less vulnerable to flipping upward in the wind if at least one of the arms 8 or 9 is biased by a spring out of the vertically upwardly extending position in the direction of the vertically downwardly extending position, relative to its own pivot point 32. Preferably, however, both arms 8, 9 are biased identically, to avoid canting of the awning.

Volute springs 33 which at one end engage a pivot tang 32 joined in a rotationally fixed manner to the associated arm 8 or 9 and at the other end abut against the guide rails 5, 6 or the associated guide slider 24 result in a space-saving arrangement.

I claim:

1. Awning construction having a wind-up roller (R);

an awning web (4) secured to the roller at one end of the web;

a cross rail (11) secured to the awning web (4) at the other end of the awning web;

a pair of parallel guide rails (5, 6) secured to a wall of a building (B) adjacent an opening to be shaded by the awning;

two arms (8, 9) having one end, each, slidable longitudinally on the guide rails (5, 6) and further pivotably connected thereto for pivoting movement from an upper, or rest position to a pivoted position, the other end of each of the two arms being connected to the cross rail (11);

first engagement element means (38) located in horizontal alignment with respect to the guide rails;

second engagement element means (42) located on the arms adjacent said one end of the arms, engageable with the first engagement element means;

wherein the first engagement element means (38) comprises at least one first projecting element (**41*a*, 41*b*) positioned in the path of movement of the second engagement element means (42**);

the second engagement element means comprises at least two second spaced projecting elements (**43*a*, 43*b*), the spacing of the second projecting elements permitting said first projecting element (41*a*, 41*b*) of the first engagement elements means (38) to fit between the spaced two second projecting elements (43*a*, 43*b***);

a cam land (44) is provided, disposed below the first engagement element means (38); and wherein a cam track (45) is provided, disposed on the underside of the associated arm (8, 9) which cooperates with the cam land in such a manner that as the substantially vertically downwardly folded arm (8, 9) slides upwardly, it is pivoted in the direction of the rest position upon engaging the cam land on the first engagement element means (38).

2. Awning construction according to claim 1, wherein the first engagement element means (38) comprises a rack associated with each guide rail of the pair of guide rails (5, 6), and the at least one first projecting element comprises rack teeth (**41*a*, 41*b*), the rack being positioned parallel to the respective guide rail; and the second engagement element means comprises a gear tooth segment (42), the at least two spaced second projecting elements being formed by gear teeth (43) of said segment, the center of rotation of the gear tooth segment being coaxial with the pivot axis (32) of the associated arm which is pivotably connected to the respective guide rail (5, 6**).

3. Awning construction according to claim 2, wherein the racks (38) are positioned at a horizontal alignment line at a level in which the uppermost rack tooth (**41*a*), upon engaging a gear tooth (43*a*), will be at the position in which the vertical movement of the arms, upon unrolling of the awning web, changes to pivoting movement of the arms (8, 9**).

4. Awning construction according to claim 2, wherein the length of the two racks (38) is dimensioned such that the lowermost tooth (43) is at a level at which the arms (8, 9), pivoted by approximately 180° from the original position, become disengaged with their gear tooth segments (42) from the rack sections (38).

5. Awning construction according to claim 2, wherein the cam land (44) and the cam track (45) are relatively positioned such that, as the substantially vertically downwardly folded arm (8, 9) slides upward, it is pivoted upon engaging the rack (38), by a predetermined angle in the direction of the rest position; and wherein the cam land (44) and the rack (38) are disposed on a common base plate (39).

6. Awning construction according to claim 1, wherein the first and second engagement elements means (38, 42) are located in the guide rail (5, 6) embodied as a longitudinally slit, hollow profile section.

7. Awning construction according to claim 5, wherein the cam land (44) is located in the guide rail (5, 6) formed as a longitudinally slit, hollow profile section.

8. Awning construction according to claim 6, wherein the first engagement element means (38) is seated in a longitudinally slit chamber (23) of the guide rail (5, 6) which is adjacent to the wall of the building and is open toward the associated arm (8, 9) and wherein the chamber (23) extends over the entire length of the guide rail (5, 6).

9. Awning construction according to claim 7, wherein the rack (38) and the cam land (44) are seated in a longitudinally slit chamber (23) of the guide rail (5, 6) which is adjacent to the wall of the building and is open toward the associated arm (8, 9), and wherein the chamber (23) extends over the entire length of the guide rail (5, 6).

10. Awning construction according to claim 1, wherein each of the arms (8, 9) is rotatably retained in an associated guide slider (24), which is longitudinally slidably guided in the associated guide rail (5, 6).

11. Awning construction according to claim 10, wherein a deflection roller (12) is provided, rotatably retained on both guide sliders (24), the deflection roller (12) extending parallel to the wind-up roller (R), the spacing of the deflection roller from the pivot point (32) of the arms (8, 9) in the two guide sliders (24) being greater than the spacing of the pivot points (32) from the cross rail (11).

12. Awning construction according to claim 10, wherein guide rollers (31) are provided;

each of the guide sliders (24) includes two U-channels (25, 26) extending parallel to one another and forming a frame, which with their base are joined spaced apart from and facing one another, the guide rollers being located at their upper and lower ends, for travel along and inside the guide rails (5, 6); and wherein the associated arm (8, 9) is retained between the profile rails (25, 26).

13. Awning construction according to claim 1, wherein at least one arm (8, 9) is spring biased, with respect to its own pivot point, out of the position extending vertically upward in the direction toward the position extending vertically downward.

14. Awning construction according to claim 13, wherein both arms (8, 9) are biased.

15. Awning construction according to claim 13, wherein volute springs (33) are provided for biasing, at one end engaging a pivot tang (32) joined in a rotationally fixed manner to the arm (8, 9).

16. Awning construction according to claim 15, wherein the volute springs (33) are supported at their other end in the guide rail (5, 6).

17. Awning construction according to claim 15, wherein the volute springs (33) are supported at their other ends in the associated guide slider (24).

* * * * *